United States Patent [19]

Hockham et al.

[11] 4,141,012

[45] Feb. 20, 1979

[54] DUAL BAND WAVEGUIDE RADIATOR

[75] Inventors: George A. Hockham, Takeley; Raymond R. Thomas, Harlow, both of England

[73] Assignee: International Standard Electric Corporation, New York, N.Y.

[21] Appl. No.: 866,096

[22] Filed: Dec. 30, 1977

[30] Foreign Application Priority Data

Jan. 27, 1977 [GB] United Kingdom ..... 3345/77

[51] Int. Cl.[2] ..... H01Q 21/00; H01Q 1/00

[52] U.S. Cl. ..... 343/729; 343/725; 343/726; 343/893

[58] Field of Search ..... 343/725, 729, 776, 781 P, 343/893, 726, 727, 730

[56] References Cited

U.S. PATENT DOCUMENTS

| | | | |
|---|---|---|---|
| 2,784,403 | 3/1957 | Marsh et al. | 343/776 |
| 2,897,491 | 7/1959 | Young, Jr. | 343/776 |
| 3,193,830 | 7/1965 | Provencher | 343/729 |
| 3,523,297 | 8/1970 | Fee | 343/729 |
| 3,882,505 | 5/1975 | Mailloux | 343/729 |

*Primary Examiner*—Alfred E. Smith
*Assistant Examiner*—Harry E. Barlow
*Attorney, Agent, or Firm*—John T. O'Halloran; Peter C. Van Der Sluys; Stephen Goldman

[57] ABSTRACT

This relates to dual band waveguide radiating element for an antenna. A pair of adjacent rear wall excited waveguide elements have a slot in the common wall between them. This slot contains an excitation element so that the structure operates as a ridge waveguide. The rear wall excitation is at the higher of the two frequencies, e.g. S band, while the ridge waveguide operates at the lower frequency, e.g. L band.

3 Claims, 1 Drawing Figure

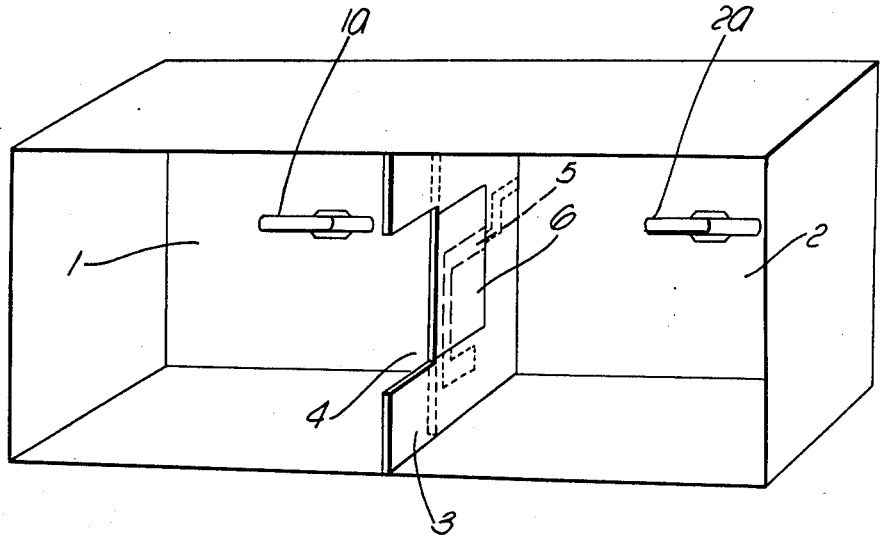
10
20
5
6
1
2
4
3

DUAL BAND WAVEGUIDE RADIATOR

BACKGROUND OF THE INVENTION

This invention relates to antennas.

There is considerable advantage in being able to use the aperture of an antenna at several different frequency bands simultaneously. In reflector antennas this is often achieved by mounting several feed horns about the focus, albeit with some degradation of pattern characteristics.

In array antennas which are required to operate at several frequencies there are two methods which are applicable, one is to use an interleaved thinned matrix of radiators which has the disadvantage that at neither frequency is the full array gain realisable and the excitation functions are restricted in form; the other method is to arrange for the elements to radiate simultaneously all the frequencies concerned. This has the advantage that the full gain of the aperture is available at both frequencies and also that there is no restriction on the excitation functions usable (within the constraints of the aperture).

SUMMARY OF THE INVENTION

According to the present invention there is provided an antenna comprising a pair of adjoining radiating waveguides each having independent excitation means located in the rear wall thereof for exciting the waveguides at a first radiation frequency and with an electric field polarisation normal to the common wall between the waveguides, said wall having a slot therein extending in depth from the edge remote from the rear of the waveguides partway towards the junction of the common wall and the rear, the slot being in width less than the width of the common wall and centrally located therein, the slot containing in substantially the centre of the common wall means for exciting the whole structure at a second radiation frequency lower than the first frequency and with an electric field polarisation parallel to the common wall.

BRIEF DESCRIPTION OF THE DRAWINGS

An embodiment of the invention will now be described with reference to the accompanying drawing which is a perspective view of an antenna according to the invention.

DESCRIPTION OF THE PREFERRED EMBODIMENT

The antenna illustrated consists of two adjoining metal waveguide radiating elements 1, 2 fabricated as a single structure, the two elements being separated by a common wall 3. Each waveguide is provided with its own excitation or driving element 1*a*, 2*a* in the rear wall. These may be printed circuit dipoles or loops. This structure radiates as two independently excited waveguides at the higher of two frequencies, e.g. in S-band, with an electric field polarisation which is horizontal (in the antenna orientation depicted). Rear excitation is necessary because usually this type of antenna is part of an array structure in which the elements of the array are packed tightly together in rows and columns.

In order to allow the antenna depicted to radiate at a lower frequency, e.g. in L-band, a slot or notch 4 is cut into the front portion of the common wall 3. This slot extends towards the rear of the structure for about $\frac{2}{3}$ of the wall depth, and does not extend for the full height of the wall, being about half the total height and centrally located in the wall. Extending from the rear of the structure into the rearward half of the notch is a driving element 5. The structure now acts as a single element of ridge waveguide with the electric field vertical. The slot in the common wall has no effect on the higher frequency waveguides since, at that frequency, no current flows in the wall across the direction of the slot. The measured polar diagram and VSWR of the higher frequency waveguide is unaffected by the presence of the slot. Thus, the whole structure operates simultaneously at two frequency bands with polarisations which are orthogonal, with a bandwidth which is in excess of 10% with singly tuned feed networks.

In practice it is convenient to fabricate the structure in the manner disclosed in our co-pending British patent application No. 143266/76 G. H. Walker 10-9-5-3-3). Thin metal plates are provided with interlocking slots and the whole is then dip-brazed to form a unitary structure which is both light in weight and rigid. The common wall 3 is formed by two parallel plates which have just sufficient space between them for the insertion of printed circuit board arrangement 6. This comprises two boards placed together, on the inner face of one of which is a conductor pattern forming the excitation element 5. The board with the conductor pattern protrudes through the rear of the structure (not shown) to provide a connector. The outer surfaces of the printed circuit boards carry ground planes which generally coincide in shape with the remaining portion of the wall, or at least part of the remaining portion. If desired, that part of the space between the metal plates not occupies by the boards can be filled with metal.

An alternative form of construction is to make the two printed circuits with the complete wall shape printed on their outer surfaces. They are then embedded into a rectangular epoxy resin structure which is metallised on 5 of its six sides to form the waveguide radiating apertures.

We claim:

1. An antenna comprising a pair of adjoining radiating waveguides each having independent excitation means located in the rear wall thereof for exciting the waveguides at a first radiation frequency and with an electric field polarisation normal to the common wall between the waveguides, said common wall having a slot therein extending in depth from the edge remote from the rear wall of the waveguides partway towards the junction of the common wall and the rear wall, the slot being in width less than the width of the common wall and centrally located therein, the slot containing in substantially the centre of the common wall means for exciting the whole structure at a second radiation frequency lower than the firt frequency and with an electric field polarisation parallel to the common wall.

2. An antenna according to claim 1 wherein the waveguide structure is fabricated from metal plates having interlocking slots, the structure being dip-brazed after assembly, the common wall being formed by two parallel plates with a space between them sufficient for the insertion thereinto of a tri-plate printed circuit board arrangement which includes the exciting means for the second frequency.

3. An antenna according to claim 1 wherein the common wall comprises a sandwich printed circuit board structure with the exciting means in the form of a printed circuit pattern in the centre of the sandwich and the notched common wall shape in the form of metal patterns on the outer surfaces of the sandwich, the sandwich then being embedded into a rectangular epoxy resin structure the outer surfaces of which are metallised to form the common wall of the waveguide structure.

* * * * *